US009867413B2

(12) United States Patent
Blecherman et al.

(10) Patent No.: US 9,867,413 B2
(45) Date of Patent: Jan. 16, 2018

(54) HELMET EXTENSION CONNECTED TO SHOULDER PAD TO PREVENT BRAIN AND SPINE INJURIES

(71) Applicants: Joshua A Blecherman, Wayne, NJ (US); Sol Blecherman, Wayne, NJ (US)

(72) Inventors: Joshua A Blecherman, Wayne, NJ (US); Sol Blecherman, Wayne, NJ (US)

( * ) Notice: Subject to any disclaimer, the term of this patent is extended or adjusted under 35 U.S.C. 154(b) by 0 days.

(21) Appl. No.: 15/467,371

(22) Filed: Mar. 23, 2017

(65) Prior Publication Data

US 2017/0188647 A1 Jul. 6, 2017

Related U.S. Application Data

(63) Continuation-in-part of application No. 14/756,106, filed on Aug. 3, 2015, now Pat. No. 9,603,405.

(51) Int. Cl.

| | |
|---|---|
| ***A42B 1/08*** | (2006.01) |
| ***A42B 3/04*** | (2006.01) |
| ***A63B 71/12*** | (2006.01) |
| ***A63B 71/08*** | (2006.01) |
| ***A42B 3/12*** | (2006.01) |

(52) U.S. Cl.

CPC ..... *A42B 3/0473* (2013.01); *A42B 1/08* (2013.01); *A42B 3/121* (2013.01); *A42B 3/125* (2013.01); *A63B 71/081* (2013.01); *A63B 71/12* (2013.01)

(58) Field of Classification Search

CPC ..... A42B 3/0473; A42B 1/08; A63B 71/12

See application file for complete search history.

(56) References Cited

U.S. PATENT DOCUMENTS

| | | | | | |
|---|---|---|---|---|---|
| 3,873,996 | A * | 4/1975 | Varteressian | A42B 3/0473 | 2/421 |
| 3,900,896 | A * | 8/1975 | Ackerman | A63B 71/1291 | 2/425 |
| 5,261,125 | A * | 11/1993 | Cartwright | A42B 3/0473 | 2/421 |
| 5,371,905 | A * | 12/1994 | Keim | A42B 3/0473 | 2/413 |
| 5,437,613 | A * | 8/1995 | Reggio | A42B 3/0473 | 2/425 |
| 5,715,541 | A * | 2/1998 | Landau | A41D 13/05 | 2/410 |
| 6,385,781 | B1 * | 5/2002 | Rose | A42B 3/00 | 2/421 |

(Continued)

*Primary Examiner* — Shaun R Hurley
*Assistant Examiner* — Andrew W Sutton
(74) *Attorney, Agent, or Firm* — Michael J. Brown

(57) ABSTRACT

A helmet supported by a vertical extension, extending from the rear-center of the helmet to the rear-center of shoulder pads or shoulder harness. The fixed in-place helmet is supported above the wearer's head, without relying upon the wearer for support, and permits the wearer to move his head in all directions. Shock absorbing material is provided between a portion of the space between the top of the head and the inside of the helmet, leaving sufficient room for head motion. The vertical extension resists elongation or compression along the vertical axis when impacted, but undergo flexure displacement in any lateral direction, followed by shape recovery after impact. The vertical extension may be adjustably attached to either the helmet or the shoulder pads.

14 Claims, 6 Drawing Sheets

(56) References Cited

U.S. PATENT DOCUMENTS 6,619,751 B1 * 9/2003 Shah ..... A42B 3/0473 2/410
6,874,140 B1 4/2005 Aaron
6,874,170 B1 * 4/2005 Aaron ..... A41D 13/0512 2/421
7,430,767 B2 * 10/2008 Nagely ..... A42B 3/0473 2/425
8,341,770 B2 * 1/2013 Siegler ..... A42B 3/0473 2/410
8,621,672 B2 * 1/2014 Chuback ..... A41D 13/0512 2/421
8,834,394 B2 * 9/2014 Ghajar ..... A61F 5/055 128/846
2002/0100109 A1 * 8/2002 Hoop ..... A41D 13/0512 2/425
2006/0096010 A1 * 5/2006 Glaser ..... A42B 3/0473 2/411
2008/0209617 A1 * 9/2008 Castillo ..... A42B 3/0473 2/461
2008/0313791 A1 * 12/2008 Nagely ..... A42B 3/0473 2/425
2010/0083424 A1 * 4/2010 Linares ..... A42B 3/12 2/413
2011/0035865 A1 2/2011 Olivarez
2011/0277225 A1 11/2011 Salkind et al.
2014/0109304 A1 4/2014 Kwan et al.
2014/0283287 A1 * 9/2014 Pocatko ..... A42B 3/0473 2/421
2014/0323921 A1 * 10/2014 Huang ..... A61B 5/4064 600/587
2015/0080768 A1 * 3/2015 Huang ..... A42B 3/0473 600/595
2015/0223542 A1 * 8/2015 Fischell ..... A42B 3/0473 2/461
2016/0037850 A1 * 2/2016 Benson ..... A42B 3/0473 2/411
2016/0157543 A1 * 6/2016 Huang ..... A42B 3/0473 2/411

* cited by examiner

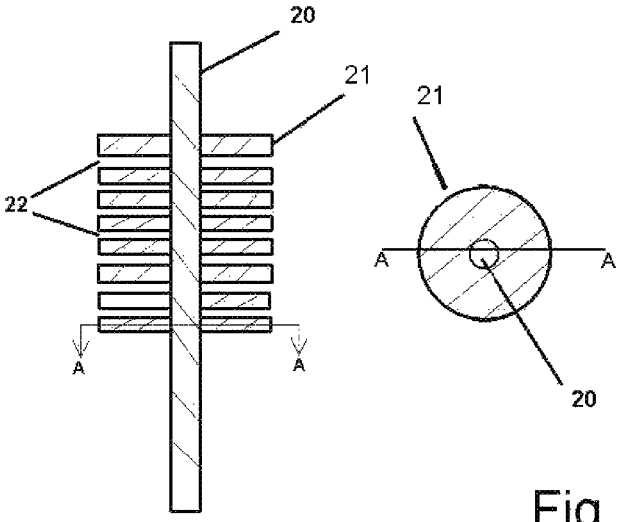
Fig. 9
Fig. 8
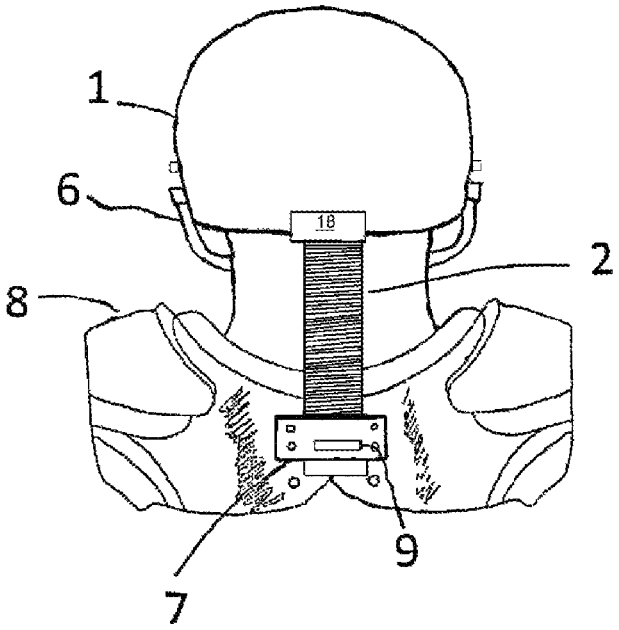
Fig. 10

HELMET EXTENSION CONNECTED TO SHOULDER PAD TO PREVENT BRAIN AND SPINE INJURIES

PRIORITY

This application is a continuation in part from pending application Ser. no. 14/756106, filed Aug. 13, 2015, and scheduled to issue as U.S. Pat. No. 9,603,405 on Mar. 28, 2017.

FIELD OF INVENTION

The invention is in the field of athletic equipment, specifically for the sport of football. Our focus was to find a way to reduce football players' head and neck injuries. Other sports and activities were also considered as possible beneficiaries of the invention's approach.

BACKGROUND

The high incidence of head and neck injuries in football continues to exact a high price on the health and well-being of high school, college and professional players. Similar head and neck injuries are noteworthy in other sports, such as skiing. In the prior art (FIG. 1) the player wears a heavy padded helmet. Although the helmet is well padded, high levels of impact to the head continue to result in blunt force trauma, whiplash and high levels of neck strain at all age levels of football participation. These injuries also have had long term effects on aging football players.

The proposed embodiment can significantly reduce these injuries by means of an improved helmet and helmet extension design and energy absorption system that will reduce head and neck trauma without restricting player visibility or head position. This embodiment incorporates an extension at the rear center of the helmet which is coupled to a shoulder harness or existing football type shoulder pads. There are three principle components to the design: The fixed-in-place helmet which does not contact the head; the flexible extension; and the shoulder pads or shoulder harness worn by the player; The flexible extension is connected to both the helmet and the shoulder pads. The invention provides an energy absorption/redistribution-shape-recoverable system which limits head deflection upon impact. The helmet extension is designed to reduce head deflection and absorb impact energy from all directions of force. The invention will significantly reduce the whiplash effect of the brain within the skull, reduce blunt force trauma, and also prevent neck injury.

The flexible and semi rigid extension is designed to transfer impact force from any direction into a shoulder pad bracket and then to the player through the pads. The extension will bend to a degree within the elastic property range of the material and section modulus, and recover to its original shape. Impact forces to the head and neck will be absorbed and attenuated by the fixed helmet, and the helmet extension simultaneously and then transferred through the helmet extension into the shoulder harness bracket and finally fully attenuated through the body of the player. This absorption and redistribution of force will reduce head and neck movement thereby decreasing the potential for whiplash of the brain within the skull and also reduce the effect of blunt force trauma to the head. Rotational head movement within the fixed helmet will not be restricted and an open helmet design permits visibility in all directions. In addition, the head will not be burdened with the additional weight of the helmet thereby decreasing the inertial momentum force upon the head and neck during impact.

Production-ready materials are available to implement this embodiment. Processional football helmet exteriors are most often fabricated of tough high impact resistant polycarbonate plastic (tensile strength=6,000 psi; modulus=300,000 psi); youth football and safety helmets are constructed of acrylonitrile butadiene styrene (ABS). These materials have good impact and strength properties and can survive repeated blows without damage. The crown area of some football helmets are constructed of vinyl nitrile. A copolymer colyene (85% polypropylene/15% polyethylene); (tensile strength=4,000 psi; modulus=195,000 psi) is used to fabricate leg braces and prosthetics. All these materials are readily available, easily formable and have good impact resistance, tensile/flexure strength, and modulus properties over a wide range. These materials can be analytically screened for effective performance using three dimensional finite element analysis for the embodiment described and the best candidates would be further evaluated in laboratory prototype impact testing.

SUMMARY OF THE INVENTION

The proposed embodiment of the design, to prevent brain and neck injuries to the wearer, will include a football type helmet, preferably not in direct contact with the wearer's head. The helmet design should provide the player with side to side visibility, as the player's head is free to move and rotate inside the fixed position helmet. The helmet may contain interior padding or the player may wear a shock absorbing cap inside the helmet. A semi-rigid, flexible member extends from the rear and center of the helmet. This extension is preferably connected to a bracket at the rear center of a shoulder pad or shoulder harness worn by the player. Unlike current helmet designs the helmet does not contact the head, and is not reliant on the player's head for support. The helmet extension will be fixed in place by a bracket mechanically attached to at least one of the rear center of the shoulder pad or rear center of the helmet, so that all of the helmet and extension weight are borne by the shoulder pads. The bottom of the helmet extension will preferably have several horizontal helmet height adjustment slots. The helmet and extension may be fixed in place with an easily insertable and removable locking pin, or similar adjustable fastener.

Force to the helmet, during impact, will be distributed into the semi-rigid, flexible extension at the back of the helmet and then into the body of the wearer through the shoulder pads. The rigidity of the helmet and extension and load sharing/distribution of force into the shoulder pads will significantly reduce head deflection and increase energy absorption during impact. This in turn will reduce whiplash and blunt force trauma and limit neck extension.

The helmet extension will be shaped and designed specifically to provide for variations in limited flexure (side-to-side, or fore-to-aft bending) upon impact, and full recovery of shape after impact, very much like a spring. The helmet extension design will preferably be rigid and unyielding to tensile or compressive forces. Any number of helmet extension materials may be candidates where their mechanical properties have been validated in varied sports and prosthetic applications.

BRIEF DESCRIPTION OF THE DRAWINGS

FIG. 8 shows a cross sectional view of an alternate embodiment of the helmet extension.

FIG. 9 shows a cross sectional view along line A-A of FIG. 8.

FIG. 10 shows an alternate embodiment of the extension.

DETAILED DESCRIPTION OF THE PREFERRED EMBODIMENT

Figure 1:
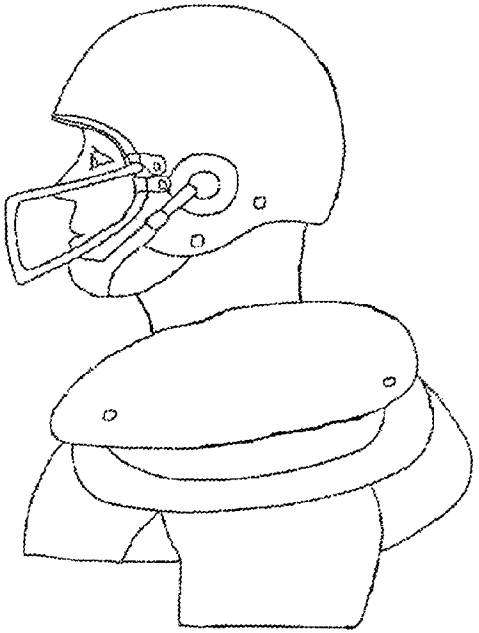
FIG. 1 depicts a side view of a prior art helmet configuration.
Figure 11:
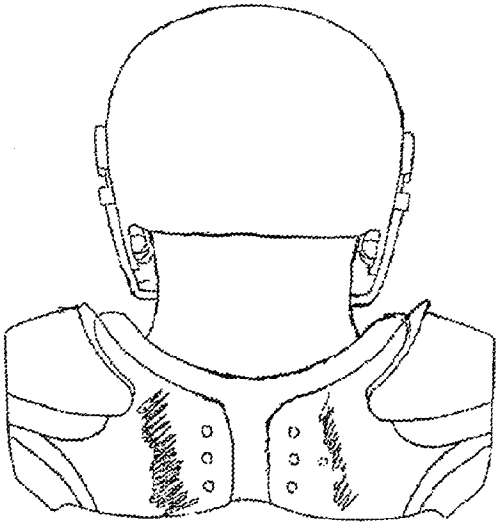
Fig. 11 (PRIOR ART)
FIG. 11 depicts a rear view of a prior art helmet configuration.

FIG. 1 shows the side and rear views of a prior helmet design. Most helmets are manufactured by injection or compression molding polycarbonate and other plastics which have good impact resistance and high tensile and modulus properties.

Figure 3:
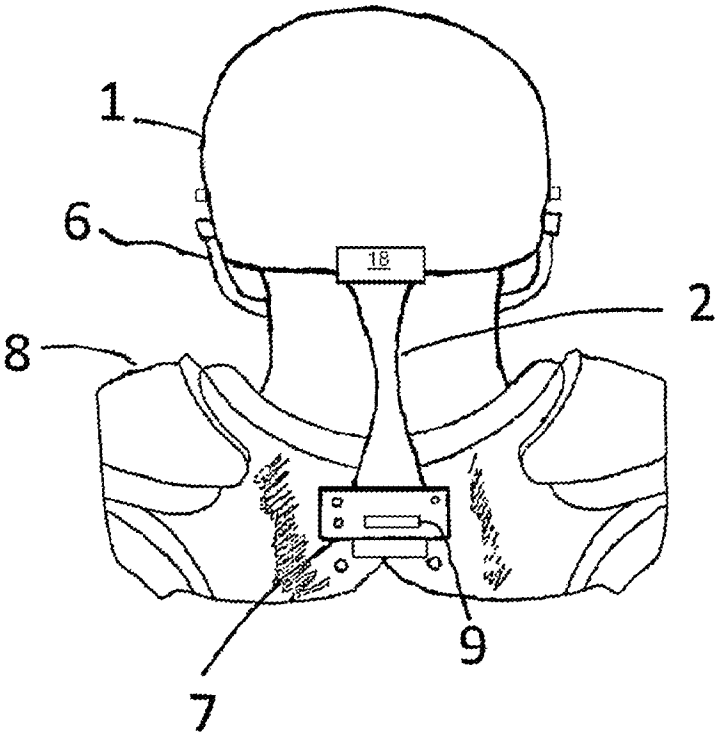
FIG. 3 depicts a rear view thereof.
Figure 2:
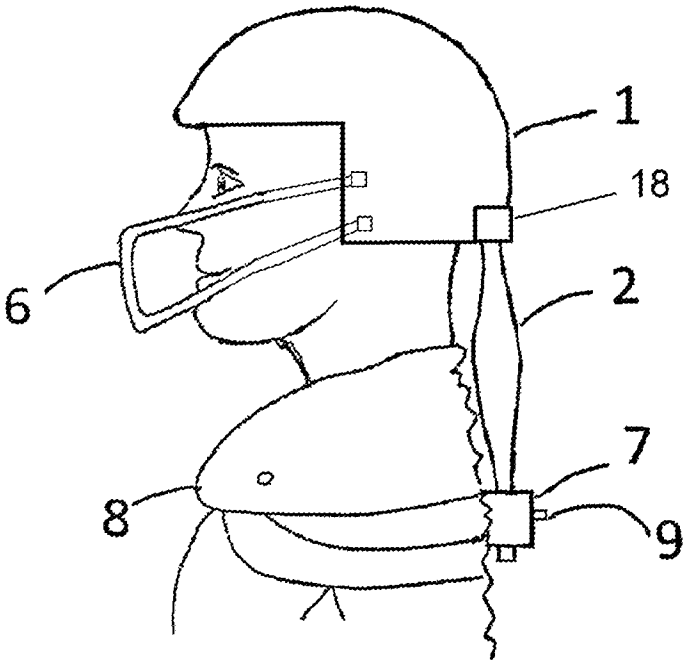
FIG. 2 depicts a side view of one embodiment of the invention.

FIGS. 2 and 3 show the side and rear views of the helmet 1 and the helmet extension 2, and one form of traditional face mask protection 6. The helmet extension is of sufficient length to engage a bracket 7 which is mechanically attached to the rear center of the shoulder pads 8. The example of bracket 7 provides a locking pin 9 that secures the helmet extension in the bracket and fix the appropriate helmet height for the wearer. Bracket 7 may be comprised of other types of fasteners as known in the art.

Impact force to the helmet 1 will be transmitted to the helmet extension 2 and then into the shoulder pads 8. Helmet 1 preferably has open front and side areas to allow visibility in at least 120 degrees, as the head is turned, and may include additional open areas to allow visibility in any direction. The embodiment shown in the figures is of a helmet used for football, but the invention may be adapted for use in other sports, or non-athletic purposes where head and neck protection is desired.

Helmet 1 may include padding on its interior surface, or the wearer may also wear a shock absorbing cap, either being located in the gap between the fixed-in-position helmet and the wearer's head. The shock absorbing cap or helmet padding can be of any of the currently available and known materials. Such shock absorbing and energy transferring materials include solids such as elastomers or more firm urethanes, or liquid or gas filled containers. These materials can be employed separately or integrated into different sections of the helmet liner cap. The shock absorbing cap, preferably with a low coefficient of friction top surface, allows the head to turn without restriction and may be held in place by straps.

The helmet 1 is fixed and does not move as the wearer turns his head. A conventional helmet may be used, or preferably, the conventional helmet may be modified to provide greater side to side visibility, either through a wider front opening, or with transparent panels added to the sides of the helmet.

The helmet extension 2 is attached at the rear center of the helmet and may be molded with the helmet as one unit or preferably as two separate pieces. Bracket 18 provides for attachment of the separate extension 2 to helmet 1. The helmet and extension may be made of materials such as polymers, metal alloys, composite metal alloys or polymer composite alloys and mechanically attached to the bottom of the helmet. The helmet and extension can be manufactured by injection molding or formed separately by compression or thermoplastic molding and then mechanically attached to the helmet. The extension may also be fabricated from a metal alloy, or a metal or plastic composite alloy.

The preferred embodiment of helmet extension, as shown in FIGS. 2 and 3, show the extension as a rectangular shaped ribbon viewed from the side and from the rear, respectively. The ribbon form of helmet extension 2 undergoes a 180 degree smooth continuous turn from its origin at the rear center of the helmet to its termination site, at the rear center of the shoulder pad 7. There are multiple advantages for this design. Regardless of the direction of impact to the helmet, the helmet extension ribbon feature will have a region along the ribbon where the maximum section modulus (resistance to bending) faces the direction of impact. In addition, the impact point on a curved surface helmet will, in almost all instances, change as the impacting body's force follows through. Therefore, new force points are continually engaging new adjacent section moduli locations on the helmet extension ribbon. This sequential multiple section modulus engagement results in attenuating the initial impact force through the extension 2 and into the bracket 7 on the shoulder pads.

Extension 2 preferably has a rectangular cross-section, where during impact, the rectangular extension 2 will bend and also rotate about its central axis to provide additional energy absorption. Extension 2 may have rounded corners. Extension 2 may also be formed with elliptical, triangular and circular cross-sections as alternate embodiments.

An additional geometric variable in the extension which can provide a benefit to this design are centerline circular holes 12 in the extension 2. The holes, if incorporated, will reduce the local flexure section modulus thereby permitting the wearer to tilt his head to the left or right (wearers can always rotate their heads) while not significantly detracting from the force attenuation benefits derived from the ribbon design. The number and size of holes, are another variable that require evaluation in a three dimensional analytical finite element evaluation and proof of concept in a laboratory prototype helmet extension program. The maximum diameter of any hole should not be greater than 50% of the width of the extension ribbon; holes may be smaller. The frequency of holes will also be determined by analysis and testing and will vary depending on the needs of the wearers' size.

Testing of prototype extension designs in the laboratory, of varying width-to-thickness ratio ribbons, will define the degree of flexure and recovery for different intensity levels and impact directions. The desirable result will be to obtain proportionally increased helmet extension (ribbon) deflection at increased loads and then full recovery of helmet extension shape and dimension. In mechanical engineering terms this means that maximum deflection of the helmet extension, from expected maximum forces on the assembled design, will not exceed the flexure strength, or the flexure or section modulus of the material with appropriate safety factors considered. Polymer candidate materials were defined earlier. In addition to material properties influencing the design there are any number of rectangular ribbon width (w)-to-thickness (t) ratios that could satisfy the design. Although the rectangular ribbon shape is illustrated in this embodiment, it is also expected that modulus and flexure strength requirements can also be met as the rectangular ribbon dimensions approach a square (w=t) or rod configuration.

An alternate embodiment of the helmet extension is shown in FIGS. 8 and 9. In this embodiment, the extension is comprised of a central rod 20, with resistance planes 21 mounted thereon. Central rod 20 is semi-rigid, and is capable of bending along its central axis, allowing lateral movement but not longitudinal compression or extension. Resistance planes 21 provide resistance to excess bending of central rod 20, as when central rod 20 bends, the surfaces of adjacent resistant planes come into contact. Resistance planes 21 are preferably comprised of an elastomeric material with high compression characteristics to absorb energy and recover their shape after the removal of force on central rod 20. The material used for central rod 20 or resistance planes 21, or the space 22 between resistance planes 21 may be varied to provide greater or lesser resistance to bending of central rod 20. In FIG. 10, resistance planes are shown as discs, but can be formed of any shape. During impact to the helmet, the central rod will bend, putting the elastomeric resistance planes into contact proportionally to the impact force.

Yet another alternative to the semi-rigid extension would be to incorporate a traditional coiled spring; either within extension 2 or by using a sufficiently resistant spring to maintain the helmet 1 in a fixed position, while providing force-dissipating properties. The material, number of coils, and diameter of coiled spring are all variables to adjust to arrive at an optimum spring constant for a given player and equipment. For the helmet extension application, the coiled spring will be designed to have the required balance of compression, extension and torsional properties to respond effectively to impact from any direction. Effective design requires maximum energy attenuation from outside impact and full recovery of shape.

Figure 5:
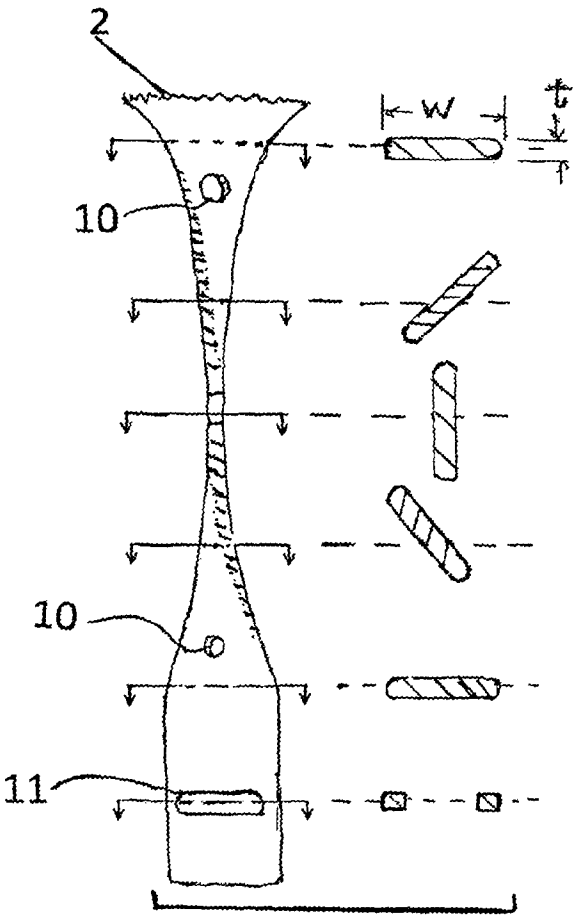
FIGS. 4 and 5 show side and rear perspective and cross sectional views of the rectangular ribbon-shaped helmet extension rotated 180 degrees about its longitudinal central axis.
Figure 4:
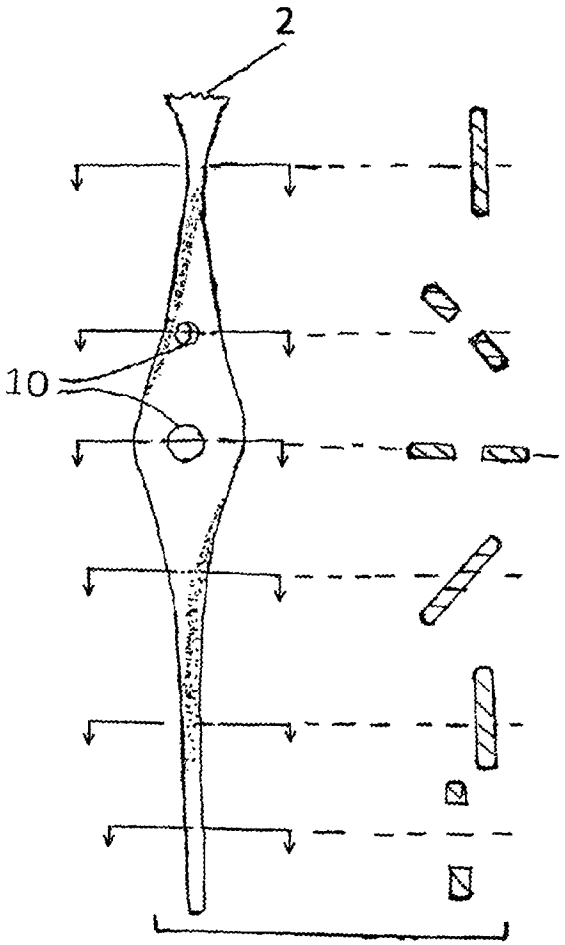

Also shown in FIGS. 4 and 5, at the bottom of the helmet extension, is one of several typical engagement slots 13 that permit the extension to be attached to the shoulder pad bracket 7 for helmet height adjustment. Bracket 18 may be constructed similar to the depiction of bracket 7 in these figures, or may be constructed of any fastener as known in the art.

Figure 6:
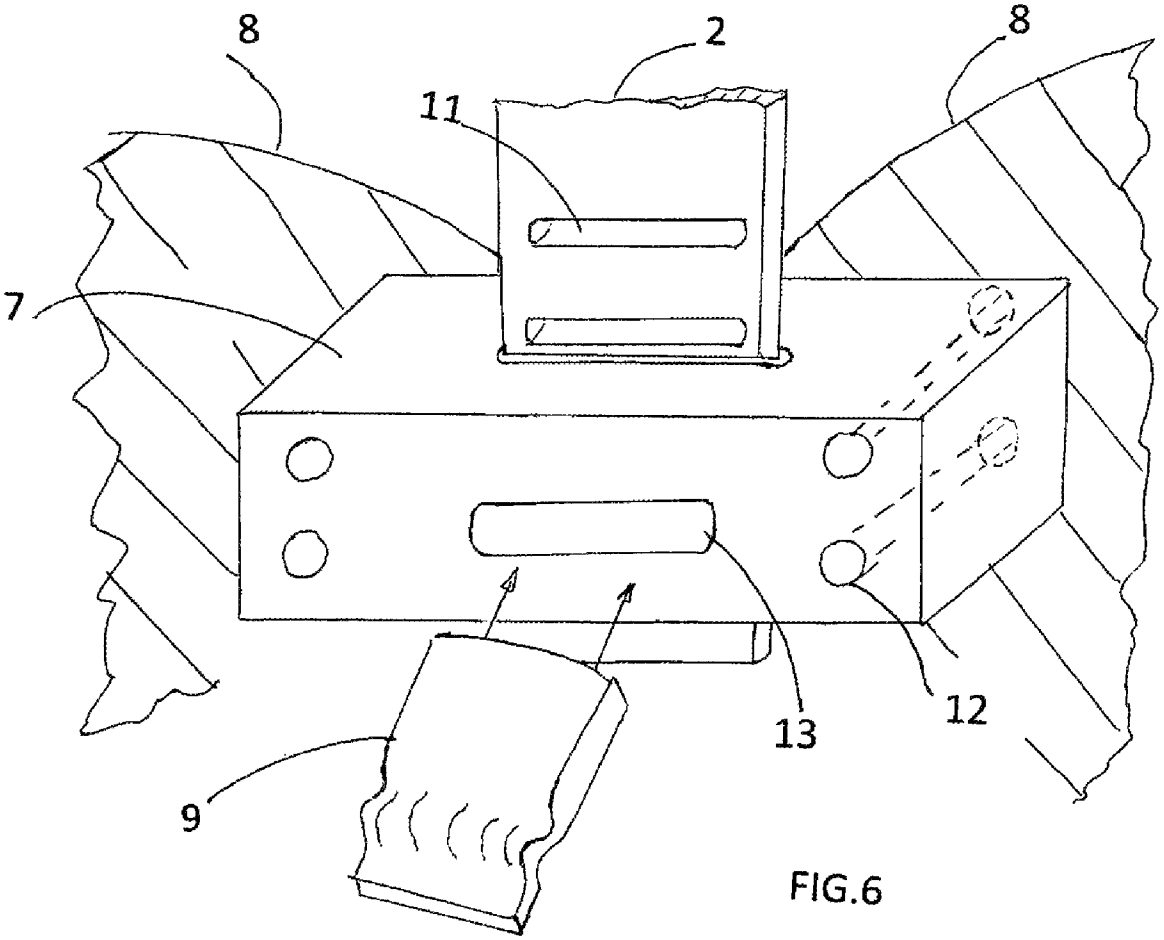
FIG. 6 is the shoulder pad attachment bracket showing the locking-pin prior to loading.

FIG. 6 shows the rear view of the helmet extension 2 fitted into the bracket 7 at the rear top center of the shoulder pads 8. The bracket is attached to the shoulder pads by conventional mechanical means such as bolts or rivets; typical bolt holes and location for attachment are shown 12. Also shown is the bracket pin 9, in the loading position, prior to entering the bracket.

Figure 7:
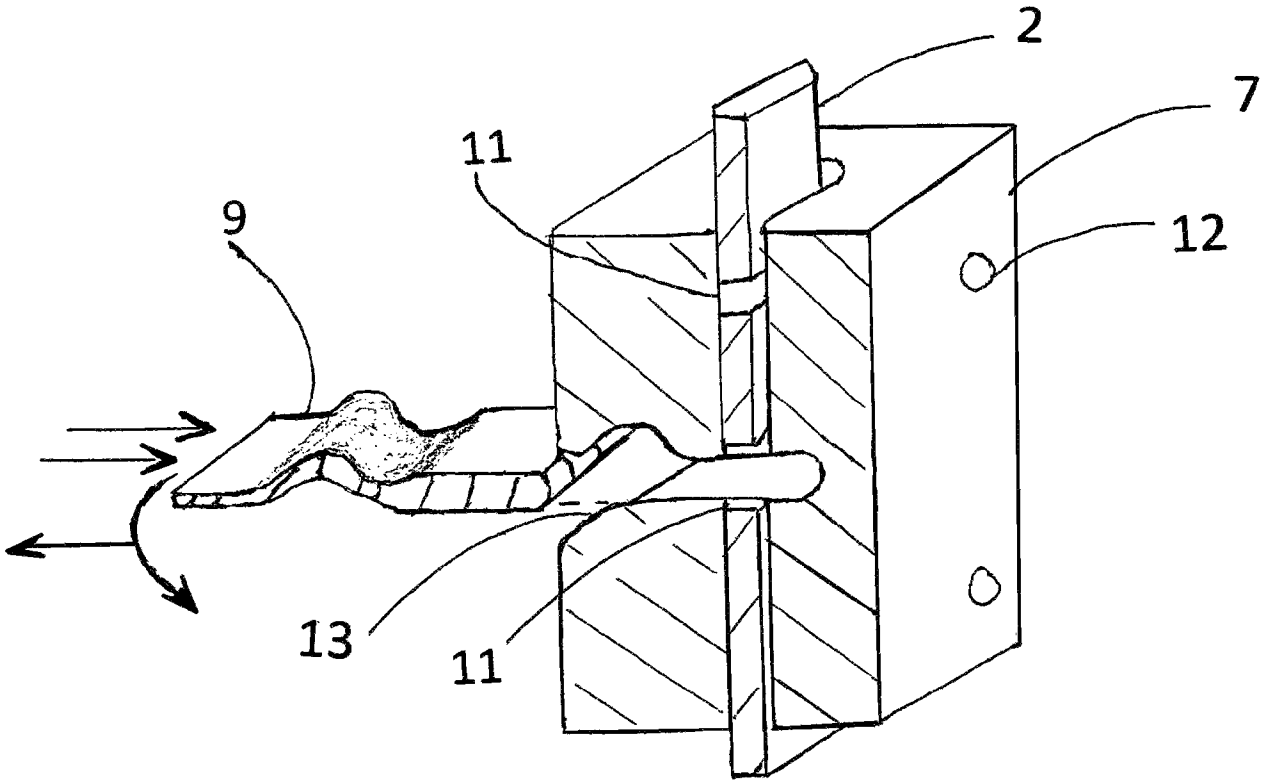
FIG. 7 shows the mid-plane section of the shoulder pad bracket with pin quick-lock-and-release features.

FIG. 7 shows the centerline section of the bracket 7 with a more detailed illustration of the rectangular pin 9 with snap-in lock features and bracket-slot contours 13 facilitating easy engagement and rapid removal. Also shown are height adjustable slots 11 in the bottom section of the helmet extension.

Three dimensional finite element analysis followed by laboratory prototype impact testing of material candidates with varying helmet extension width-to-thickness ratios would identify the ideal helmet extension design for the range of player size, from little league to professional football, and for different sports.

While certain novel features of the present invention have been shown and described, it will be understood that various omissions, substitutions and changes in the forms and details of the device illustrated and in its operation can be made by those skilled in the art without departing from the spirit of the invention.

We claim:

1. A head and neck shock absorbing and deflection attenuation system comprised of:

a helmet with an interior cavity and a rear side, the helmet allowing a wearer to have side to side visibility;

an elongated extension with an upper end and a lower end, the elongated extension resistant to compression along its length, where the elongated extension comprises a ribbon with a cross-section having a greater width than thickness, where the ribbon undergoes a rotation of at least 180 degrees from the upper end to the lower end;

shoulder pads with a rear side; and shock absorbing padding in the interior cavity of the helmet, capable of being located between the interior cavity of the helmet and a wearer's head, where the elongated extension is attached at its upper end to the rear side of the helmet and is attached at its lower end to the rear side of the shoulder pads, and the elongated extension supports the helmet in a fixed position relative to the shoulder pads, limiting rotation of the helmet, and where the elongated extension allows lateral displacement of the helmet upon impact, and recovers its shape after impact.

2. The head and neck shock absorbing and deflection attenuation system of claim 1, where the elongated extension further comprises openings within the elongated extension.

3. The head and neck shock absorbing and deflection attenuation system of claim 1, further comprising:

an lower bracket attached to the shoulder pads securing the lower end of the elongated extension.

4. The head and neck shock absorbing and deflection attenuation system of claim 3, where the lower bracket is a height adjustable bracket.

5. The head and neck shock absorbing and deflection attenuation system of claim 1, further comprising:

an upper bracket attached to the helmet securing the upper end of the elongated extension.

6. The head and neck shock absorbing and deflection attenuation system of claim 5, where the upper bracket is a height adjustable bracket.

7. The head and neck shock absorbing and deflection attenuation system of claim 1, where the elongated extension is configured to have decreased flexure bending stiffness in localized areas to permit a wearer to tilt his or her head.

8. The head and neck shock absorbing and deflection attenuation system of claim 1, where the elongated extension further comprises a spring.

9. A head and neck shock absorbing and deflection attenuation system comprised of:

a helmet with an interior cavity and a rear side, the helmet allowing a wearer to have side to side visibility;

an elongated extension with an upper end and a lower end, the elongated extension resistant to compression along its length, where the elongated extension comprises a central rod, and a plurality of planar members along the central rod, with spaces between adjacent planar members, where at least one of the central rod and planar members allow lateral displacement of the helmet upon impact and recovers its shape after impact;

shoulder pads with a rear side; and shock absorbing padding in the interior cavity of the helmet, capable of being located between the interior cavity of the helmet and a wearer's head, where the elongated extension is attached at its upper end to the rear side of the helmet and is attached at its lower end to the rear side of the shoulder pads, and the elongated extension supports the helmet in a fixed position relative to the shoulder pads, limiting rotation of the helmet, and where the elongated extension allows lateral displacement of the helmet upon impact, and recovers its shape after impact.

10. The head and neck shock absorbing and deflection attenuation system of claim 9, further comprising:

a lower bracket attached to the shoulder pads securing the lower end of the elongated extension.

11. The head and neck shock absorbing and deflection attenuation system of claim 10, where the lower bracket is a height adjustable bracket.

12. The head and neck shock absorbing and deflection attenuation system of claim 9, further comprising:

an upper bracket attached to the helmet securing the upper end of the elongated extension.

13. The head and neck shock absorbing and deflection attenuation system of claim 12, where the upper bracket is a height adjustable bracket.

14. The head and neck shock absorbing and deflection attenuation system of claim 9, where the elongated extension is configured to have decreased flexure bending stiffness in localized areas to permit a wearer to tilt his or her head.

* * * * *